US009468965B2

(12) United States Patent
Radtke

(10) Patent No.: US 9,468,965 B2
(45) Date of Patent: Oct. 18, 2016

(54) METHOD FOR SHAPING AN ESSENTIALLY FLAT-SURFACED BLANK TO FORM A SHELL BODY AND USE THEREOF

(75) Inventor: Wulf Radtke, Planegg (DE)

(73) Assignee: MT Aerospace AG, Augsburg (DE)

( * ) Notice: Subject to any disclaimer, the term of this patent is extended or adjusted under 35 U.S.C. 154(b) by 746 days.

(21) Appl. No.: 13/638,036

(22) PCT Filed: Mar. 28, 2011

(86) PCT No.: PCT/EP2011/001547
§ 371 (c)(1),
(2), (4) Date: May 17, 2013

(87) PCT Pub. No.: WO2011/124340
PCT Pub. Date: Oct. 13, 2011

(65) Prior Publication Data

US 2013/0219981 A1 Aug. 29, 2013

(30) Foreign Application Priority Data

Mar. 29, 2010 (DE) ..... 10 2010 013 206

(51) Int. Cl.
*B21D 22/18* (2006.01)
*B21D 22/20* (2006.01)

(52) U.S. Cl.
CPC ..... *B21D 22/20* (2013.01); *B21D 22/185* (2013.01)

(58) Field of Classification Search
CPC .... B21D 22/16; B21D 22/18; B21D 22/185; B21D 35/007; B21D 22/20
See application file for complete search history.

(56) References Cited

U.S. PATENT DOCUMENTS

| | | | | |
|---|---|---|---|---|
| 3,132,420 | A | 5/1964 | Pompa | |
| 3,355,920 | A | 12/1967 | Ellenburg | |
| 3,979,815 | A | 9/1976 | Megumi et al. | |
| 4,644,626 | A | 2/1987 | Barnes et al. | |
| 5,218,849 | A | 6/1993 | Sieger et al. | |
| 7,454,936 | B2 * | 11/2008 | Michel et al. | 72/69 |
| 7,644,600 | B1 | 1/2010 | Michel et al. | |
| 2003/0006270 | A1 | 1/2003 | Favre-Marinet et al. | |

FOREIGN PATENT DOCUMENTS

| | | | |
|---|---|---|---|
| DE | 807805 | C | 7/1951 |
| EP | 1728567 | A1 | 12/2006 |

* cited by examiner

*Primary Examiner* — Debra Sullivan
(74) *Attorney, Agent, or Firm* — Rothwell, Figg, Ernst & Manbeck, PC

(57) ABSTRACT

The invention relates to a method for shaping an essentially flat-surfaced blank (10) to form a shell body (34), comprising the following steps: forming at least one flat-surfaced, buckling-stable insert (12) which is adapted to form, dimension and deformation properties of the flat-surfaced blank (10); forming a blank (14) to be deformed and at least one buckling-stable insert (16, 16', 16") to be deformed from the flat-surfaced blank (10, 10') and the at least one flat-surfaced buckling-stable insert (12, 12'); placing and clamping the blank (14) to be deformed and the at least one buckling-stable insert (16, 16', 16") relative to one another and deforming the blank (14) together with the at least one buckling-stable insert (16, 16', 16") to be deformed in order to form the shell body, using at least one forming tool (32) that acts upon the front or inner side (20) of the blank (14) to be deformed or the at least one insert (16) to be deformed which is provided as a support. The invention also relates to the use of said shell body (34) to produce rotationally symmetric and/or not rotationally symmetric shell-shaped components.

19 Claims, 3 Drawing Sheets

Fig. 3
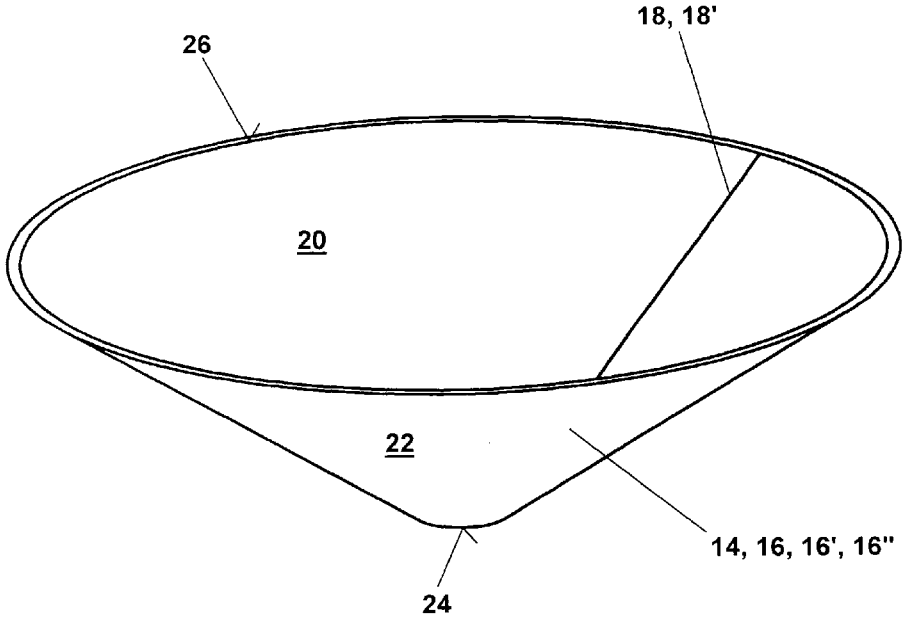
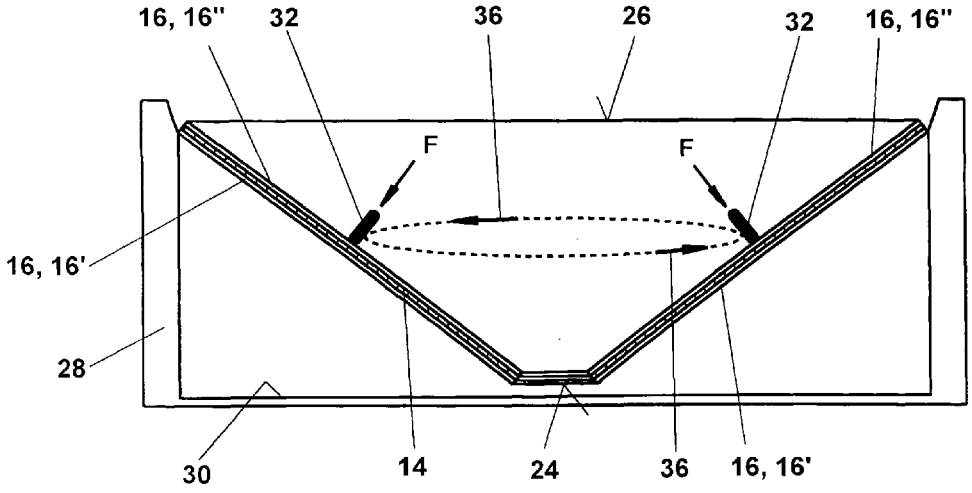
Fig. 4

METHOD FOR SHAPING AN ESSENTIALLY FLAT-SURFACED BLANK TO FORM A SHELL BODY AND USE THEREOF

CROSS REFERENCE TO RELATED APPLICATION

This application is a 35 U.S.C. 371 National Phase Entry Application from PCT/EP2011/01547, filed Mar. 28, 2011, which claims the benefit of German Patent Application No. 10 2010 013 206.3 filed on Mar. 29, 2010, the disclosure of which is incorporated herein in its entirety by reference.

BACKGROUND OF THE INVENTION

1. Field of the Invention

The present invention relates to a method for shaping an essentially flat-surfaced blank to form a shell body and the use thereof.

2. Background of the Related Art

Methods of this nature to manufacture shell bodies from essentially flat-surfaced blanks, round plates or similar sheet-metal panels are generally known. EP 1 728 567 B1, for example, relates to a method and a pertinent device for shaping an essentially flat-surfaced blank in form of a round and/or discoidal sheet-metal element to form a shell body with distinct reduction of its wall thickness. In this process, a rotating, flat-surfaced, circular blank, for example a pre-shaped round plate, is attached to a ring or clamping plate along its circumference, is flared with a roll into an open space behind the ring or clamping plate and, as appropriate, is shaped to forma rotation-symmetric shell body with end-shaped dimensions. Depending upon the degree of required concavity, this is usually done in several separate steps, whereby the round-plate material is plastically extended and is azimuthally stretched owing to surface expansion in the membrane section. This method and the pertinent device have already absolutely proven their worth in practical application. In the process of shaping of shell bodies with small wall-thickness/diameter ratios, creases might form in the sheet metal. In order to reduce the formation of creases, which in addition depends upon the E-module of the material to be shaped at the selected shaping temperature, and the amount of subsequent mechanical post-processing work, additional devices are recommended, which according to U.S. Pat. No. 3,355,920 are designed to enable calibration of the shape.

SUMMARY OF THE INVENTION

The object of this invention is therefore to provide a method for shaping of an essentially flat-surfaced blank into a shell body, by means of which the aforementioned disadvantages can be prevented, which accordingly enables easy and cost-efficient shaping of an essentially flat-surfaced blank to form a shell body whilst avoiding the formation of creases, and making it available for use.

This is achieved in astonishingly easy manner by the characteristics of claim 1.

By designing the method according to the invention to shape an essentially flat-surfaced blank into a shell body, comprising the following steps:

a) Forming of at least one flat-surfaced buckling-stable insert which is adapted to form, dimension and deformation properties of the flat-surfaced blank;

b) forming of a blank to be deformed and at least one buckling-stable insert to be deformed from the flat-surfaced blank and the at least one flat-surfaced buckling-stable insert, whereby an insert intended as base in its dimensions is a bit larger than the blank intended to be deformed and/or an insert intended as lining in its dimensions is a bit smaller than the blank to be deformed;

c) positioning the blank to be deformed and the at least one buckling-stable insert to be deformed to each other such that the blank to be deformed and the at least one buckling-stable insert to be deformed after such arrangement and throughout the entire deformation of the blank to be deformed are in full-surface mutual contact to the shell body;

d) clamping the blank to be deformed and the at least one buckling-stable insert to be deformed in or at a bearing structure; and e) deforming the blank to be deformed together with the at least one buckling-stable insert to be deformed with the help of at least one forming tool contacting the front or inner side of the blank to be deformed or the at least one insert to be deformed intended as lining to form the shell body;

a method is recommended, by which an essentially flat-surfaced blank may be easily and cost-efficiently shaped into a shell body, thereby avoiding any formation of creases. The blank to be deformed is prevented from buckling by one or two buckling-stable inserts and/or is formed in such stable form that the risk of crease formation is eliminated. The buckling-stable inserts are thus formable, even if particularly limited deformable. The buckling stability of these inserts may be provided either by their thickness as well as by choosing adequate material, i.e. by choosing a material with a particularly high E-module.

Other advantageous characteristics of the method according to the invention are described in claims 2 through 20.

It is in the scope of the invention that the blank to be deformed and the buckling-stable insert to be deformed according to claim are composed of a flat-surfaced blank and at least one flat-surfaced buckling-stable insert which are each essentially circular or discoidal or which are each shaped as partially circular ring.

In this context, a preferred embodiment of the invention provides that the flat-surfaced blank and the at least one flat-surfaced buckling-stable insert which are each essentially circular or discoidal or which are each shaped as partially circular ring according to claim 3 are worked from the flat-surfaced blank and the at least one flat-surfaced buckling-stable insert by separating, in particular by mechanical cutting, cutting with laser or water jet, sawing, milling or eroding of the flat-surfaced blank and the at least one flat-surfaced buckling-stable insert. These characteristics are expedient for simple, precise, efficient and cost-efficient processes.

Particular importance is attached to the measures in claim 4. According to these, the blank to be deformed and the buckling-stable insert to be deformed are joined from the flat-surfaced blank and the at least one flat-surfaced buckling-stable insert, which are each shaped as partially circular ring, to a blank to be deformed and at least one buckling-stable insert to be deformed, which are each shaped in form of a truncated cone. This recommended procedure owing to improved exploitation of available heat and energy potentials leads to significant reduction of energy costs and less time expenditure and thus to increased economic efficiency. In the method according to the invention, the truncated-cone shaped blank is considerably closer to the shell body than is the flat-surfaced circular and/or discoidal blank. As a consequence, the required degree of shaping may be considerably reduced in comparison with the shaping of a flat-surfaced circular blank, which prevents or at least considerably decreases restrictions in terms of shaping, as for example material failures in the base material and in particular in the critical welding sector or formation of creases. This again enables the manufacture of shell bodies with much greater ratios between axial length and diameter than before. An additional advantage is that the shell bodies in proportion to their diameters may have thinner walls and thus require less material input and may be manufactured easier than this was possible before due to crease formation. In addition, the method according to the invention also enables omittance of one or several manufacturing phases, which in the prior art were required for shaping a flat-surfaced circular blank. Up to 95% of the manufacturing phases required in the prior art might be omitted. Such application may lead to considerable reduction of production costs, higher production output rates and improved economic efficiency rates in general. At the same time, shaping and dimensional accuracy is increased and the shell body thus manufactured has an extremely high degree of stability.

Of particularly high interest are the construction-related characteristics of claim 5, according to which the blank to be deformed and the at least one buckling-stable insert to be deformed are joined by friction-stir-welding (FSW) along opposite surface lines of the flat-surfaced blank and the at least one flat-surfaced buckling-stable insert. This friction-stir-welding has considerable advantages as opposed to conventional welding methods, above all if the welding seam(s) is/are subsequently subjected to high tensions due to further deformation as with concave pressing and/or spin forming and/or counter rolling and/or hammering and/or ball peening. This friction-stir-welding is particularly favorable owing to the principal ability to work below the melting point, the slight warping in welding seam(s), excellent mechanical characteristics of the welding seam(s), no formation of blow holes, cavities, and welding spatters, very insignificant shrinkage, if any, and favorable repair possibilities.

Preferably the blank to be deformed and the at least one buckling-stable insert to be deformed according to claim 6 are clamped and fixed with a pressure ring and a clamping ring as well as in particular a sealing ring between pressure ring and clamping ring in or at the bearing structure along an circumference in the area of a large aperture of the blank to be deformed and the at least one buckling-stable insert to be deformed through a facility for clamping the blank to be deformed and the at least one buckling-stable insert to be deformed.

The characteristics of claim 7 are also of particular importance for economically efficient and explicitly accurate shaping and dimensional accuracy of the manufactured shell body as well as increased stability. According to these, the blank to be deformed and the at least one buckling-stable insert to be deformed are both preferably shaped into the shell body by concave pressing and spin forming, respectively. Concave pressing has the advantage that shaping in every rollover phase progresses forward, is strictly limited in terms of time and in radial deforming in terms of deforming degree is defined by the particular used template. As an alternative or also cumulative, deforming according to the invention may also be accomplished by counter rolling and/or hammering and/or ball peening.

For blanks to be deformed with larger wall thicknesses or with complicated meridian geometry, it is a particular advantage that the blank to be deformed and the at least one buckling-stable insert to be deformed according to claim 8 are shaped to form a shell body by at least one forming tool contacting its front or inner side similar or identical to the principle of "concave pressing". Such forming tool may be in form of at least one forming or pressing roll and/or a pressing ball, which then preferably is hydrostatically mounted. Other forming tools as an alternative may also be at least one interacting counter roll which contacts the rear or outer side of the blank to be deformed and the at least one buckling-stable insert to be deformed and/or at least one hammer and/or balls made of metal, glass or a combination thereof.

According to the measures stated in claim 9, influence may be exerted upon the dimensional accuracy of the blank to be deformed and later shell body during the shaping process and/or forming process or concave pressing such that the forming tool contacting the front or inner side of the blank to be deformed or the at least one buckling-stable insert to be deformed is arranged in one level radially to the blank to be deformed or the at least one buckling-stable insert to be deformed two-dimensionally from the center to the circumference of the blank and the at least one buckling-stable insert, and vice versa, or from the circumference in the area of a small aperture to the circumference in the area of a large aperture of the blank and the at least one buckling-stable insert, and vice versa. This possibly also optional arrangement is expedient to achieve considerably shortened traverse paths of the forming tool. Processes overall may proceed much faster as a consequence. As a principle rule, the spatial motion of the at least one forming tool may be relative to the blank in form of spatial spiral on the surface and/or inner side of the truncated-cone shaped blank from the inside to the outside, or vice versa, from the outside to the inside, which will bring about the required geometry of the shell body. The spiral form is the result of the superimposition of the radial two-dimensional motion with the rotation of the truncated-cone shaped blank as third dimension. A relative motion between blank and forming tool may also be achieved in phases or steps by way of respectively adapted setting and in any combination of the respective basic motions to achieve a desired geometry.

The characteristics of claim 10 are expedient to further increase the dimensional accuracy and stability, respectively, which can be achieved with the method according to the invention, whereby the forming tool in contact with the front or inner side of the blank to be deformed and the at least one buckling-stable insert to be deformed is steered and/or controlled by a template or numerical controls. The final geometry of the shell body may be defined by the meridian curve of a (sheet metal) template and/or by programming the meridian curve of the (sheet metal) template into an NC device. As only the template and/or NC controls for the forming tool need to be changed, subsequent geometry changes or geometry adaptations for shell bodies with different shapes are possible without requiring any extensive time or personnel input, thus reducing costs.

Expediently, according to claim 11, the blank to be deformed and the at least one buckling-stable insert to be deformed and the at least one forming tool are moved relative to each other, in particular turned, during deforming to form the shell body. This may be accomplished by the motion of the forming tool and/or a relative movement additional to movement of the forming tool and/or relative rotation of the blank to be deformed and buckling-stable insert and/or the bearing structure or the chamber of the bearing structure itself.

In another embodiment of the method according to the invention, the blank to be deformed according to claim 12 may be heated to a higher temperature profile by at least one device allocated to the bearing structure for heating the blank to be deformed.

In this context, it is particularly important that the blank to be deformed according to claim 13 is soft-annealed prior to being shaped to form the shell body. Shaping and/or forming or concave pressing are easier and the more reliable to accomplish the softer and more ductile the material is. Soft annealing is expedient for releasing inner tensions and differences in form retention stability caused by welding.

In addition, the construction-related measures provided in claim 14 are particularly interesting for achieving the desired ultimate wall thickness of the shell body. According to these, the flat-surfaced blank or the essentially circular or discoidal blank or the blank in form of a partially circular ring or the blank to be deformed may be precontoured prior to shaping to form the shell body by machining, particularly by milling, cutting and/or grinding, i.e. provided with a specific and particular wall thickness in planar state, and/or with apertures, perforations or similar excavations, which are temporarily closed for shaping by the at least one buckling-stable insert to be deformed and/or covers, in particular a foil. The ultimate wall thickness of the shell body may be exactly set by precontouring the initial thickness prior to the shaping process. Practical application has shown the particular advantage that contouring is best applied to the blank's outside. This approach assures that the forming tool comes in contact with the non-contoured smooth inner side of the truncated-cone shaped blank, provided such forming tool is at all required. By using at least one buckling-stable insert to be deformed, particular coverings or foils are not required.

It may also be particularly advantageous to use the method according to the invention for shaping and/or forming or pressing by using the technical characteristics of claim 15 in form of vacuum. Accordingly, the rear or outer side of the blank to be deformed facing the bearing structure and of the buckling-stable insert to be deformed intended as base is sealed against the front or inner side of the blank to be deformed or of the buckling-stable insert to be deformed intended as lining opposite to the bearing structure and a vacuum is applied at a chamber of the bearing structure closed against the blank to be deformed and/or the at least one buckling-stable insert to be deformed. The process of shaping the blank to be deformed and the at least one buckling-stable insert to be deformed is thus supported by defined evacuation of the chamber. If the process for shaping the truncated-cone shaped blank is to be supported by additional application of a vacuum, the aforementioned apertures, perforations and other similar excavations of the truncated-cone shaped blank may be temporarily sealed by at least one buckling-stable insert to be deformed or separate covers, in particular a foil.

In order to increase the achievable dimensional accuracy, the invention also intends in compliance with claim 16 to continuously measure the blank to be deformed during the process of shaping to form the shell body. Such geometric measurement of the blank may, for example, be done automatically by a, if appropriate, contact-free swiveling measurement system. Such geometric measurement is particularly advantageous to gain data for adaptation of the parameters of a parallel and/or subsequent shaping process.

According to the measures as in claim 17, the truncated-cone shaped blank in an advantageous application is subjected to solution heat treatment followed by quenching as well as, where required, by cold drawing.

In addition, the shell body according to the characteristics of claim 18 is heat-soaked in the bearing structure or in the oven and is brought to status T8 after shaping and/or forming or concave pressing. In particular if the shell body consists of metal, specifically of aluminum or an aluminum alloy, optimal hardening and tempering is usually most appropriate to achieve status T8 in material characteristics. Status T8 is currently the maximum achievable status for temperable and hardenable aluminum alloys frequently used for rocket fuel tanks.

Expediently, the flat-surfaced blank and/or the at least one flat-surfaced buckling-stable insert and/or the blank to be deformed and/or the at least one buckling-stable insert to be deformed according to claim 19 are made of metal, in particular steel, stainless steel, aluminum, titanium, an alloy thereof and/or a combination thereof, preferably high and super high strength aluminum alloys and aluminum alloys containing lithium, and most preferably, where required, curable aluminum alloys AL 2195 or AL 2219, and/or plastic and/or ceramics and/or a combination thereof.

It is in the scope of the invention that the at least one flat-surfaced buckling-stable insert or the at least one buckling-stable insert to be deformed according to claim 16 is made of a material with a high E-module.

Finally, it is in the scope of the invention to use the method according to the invention, according to some embodiments, to manufacture rotationally symmetric and/or not rotationally symmetric shell-shaped components. Hemispherical, spherical-shaped, dome-shaped, ellipsoid-spherical shaped, cone-shaped or ellipsoid components and/or components in Cassini-form, semi-torus form or components with other similar cross-sectional shapes have proven to be particularly advantageous.

The method according to the invention, according to some embodiments, is very particularly suited for the manufacture of shells as domes for rocket fuel tanks, satellite tanks, parabolic antennas, parabolic reflector shells, parabolic solar collectors, headlamp housings, container floors, tower cupolas, pressure domes, etc.

BRIEF DESCRIPTION OF THE DRAWINGS

Other characteristics, advantages and particulars of the invention are stated in the following description of preferred embodiments of the invention and in the drawings. These show:

FIG. 3 a perspective view of an embodiment of a blank to be deformed according to the invention and/or of a buckling-stable insert to be deformed according to the invention, which is joined by welding along opposite surface lines of the blank shaped in form of a partial circular ring and the insert as in FIG. 2;

FIG. 4 a schematic cross-sectional view of an embodiment of a blank to be deformed according to the invention as in FIG. 3 together with two buckling-stable inserts to be deformed and used as base and/or lining, which is clamped into a bearing structure and by way of a preferred embodiment of a method according to the invention is shaped to form a shell body with at least one forming tool.

DETAILED DESCRIPTION

In the following description of various embodiments of the method according to the invention, identical component parts are identified by identical reference numbers.

The method according to the invention is intended for shaping and/or forming an essentially flat-surfaced blank 10 made of metal, in particular steel, stainless steel, aluminum, titanium, an alloy thereof and/or a combination thereof, preferably high and super high strength aluminum alloys and aluminum alloys containing lithium, and most preferably a preferably curable aluminum alloy, for example AL 2195 or AL 2219, and/or plastic and/or ceramics and/or a combination thereof to form a shell body—possibly also with thin walls in particular—, shell-shaped component or similar formed part both in cold and warm condition.

The method according to the invention is particularly suited for manufacturing rotationally symmetric and/or not rotationally symmetric shell-shaped components. The manufacture of hemispherical, spherical-shaped, dome-shaped, ellipsoid-spherical shaped, cone-shaped or ellipsoid components, components in Cassini-form, semi-torus form or components with other cross-sectional shapes has proven to be a particularly advantageous embodiment of the method according to the invention.

The method according to the invention is very particularly suited for the manufacture of shells as domes for rocket fuel tanks, satellite tanks, parabolic antennas, parabolic reflector shells, parabolic solar collectors, headlamp housings, container floors, tower cupolas, pressure domes or similar.

Figure 1:
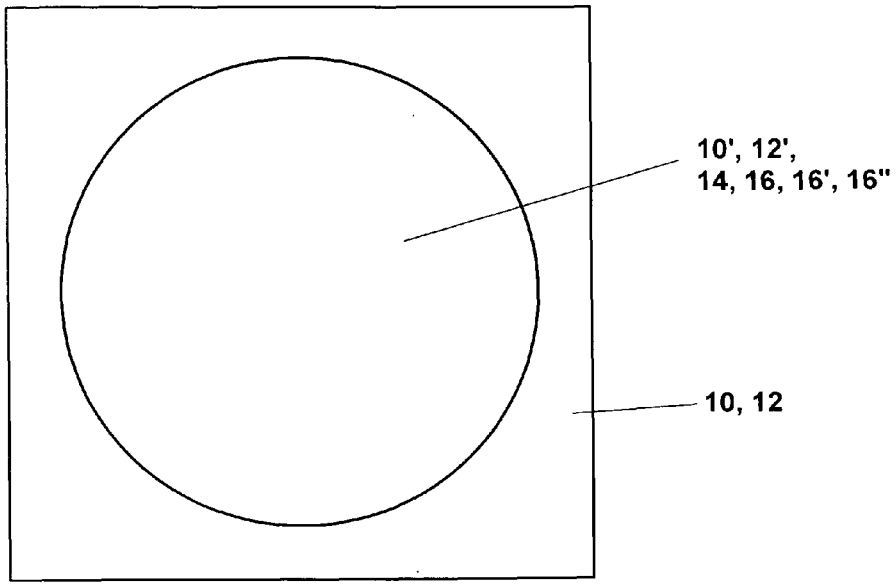
FIG. 1 a plan view on an embodiment of a flat-surfaced and circular or discoidal blank and buckling-stable insert, respectively, according to the invention.

According to FIG. 1, the method according to the invention encompasses a first step in which at least one buckling-stable insert 12 or similar base and/or lining is formed. The at least one buckling-stable insert 12 or similar base and/or lining is thus deformable, even if in particular limited deformable, to the extent to avoid any formation of creases in the blank 10 to be deformed and/or to stabilize the blank 10 to be deformed such that the risk of crease formation is eliminated. The at least one buckling-stable insert 12 is adapted to the flat-surfaced blank 10 in terms of form, dimension and deformation properties. According to FIG. 1, the flat-surfaced blank 10 and the at least one buckling-stable insert each have the shape of a (square/rectangular) plate or sheet-metal panel.

In a second step of the method according to the invention, a flat-surfaced blank 10' and at least one flat-surfaced buckling-stable insert 12' are formed from the flat-surfaced blank 10 and the at least one flat-surfaced buckling-stable insert 12. According to FIG. 1, the blank 10' and the at least one insert 12' are each essentially shaped circular or discoidal.

In this process, the flat-surfaced blank 10' and the flat-surfaced buckling-stable insert 12' are worked from the flat-surfaced blank 10 and the at least one flat-surfaced buckling-stable insert 12 by separation, in particular by mechanical cutting, cutting with laser or water jet, sawing, milling or eroding, of the flat-surfaced blank 10 and the at least one flat-surfaced buckling-stable insert 12.

The flat-surfaced blank 10' and the flat-surfaced buckling-stable insert 12', each worked out, in the embodiment shown in FIG. 1 themselves form a blank 14 to be deformed and at least one buckling-stable insert 16 to be deformed. The blank 14 to be deformed and the at least one buckling-stable insert 16 accordingly each feature a circular and/or discoidal shape. An insert 16 intended as base 16' in its dimensions will be a bit larger than the blank 14 to be deformed and/or an insert 16 intended as lining 16" in its dimensions is a bit smaller than the blank 14 to be deformed.

Figure 2:
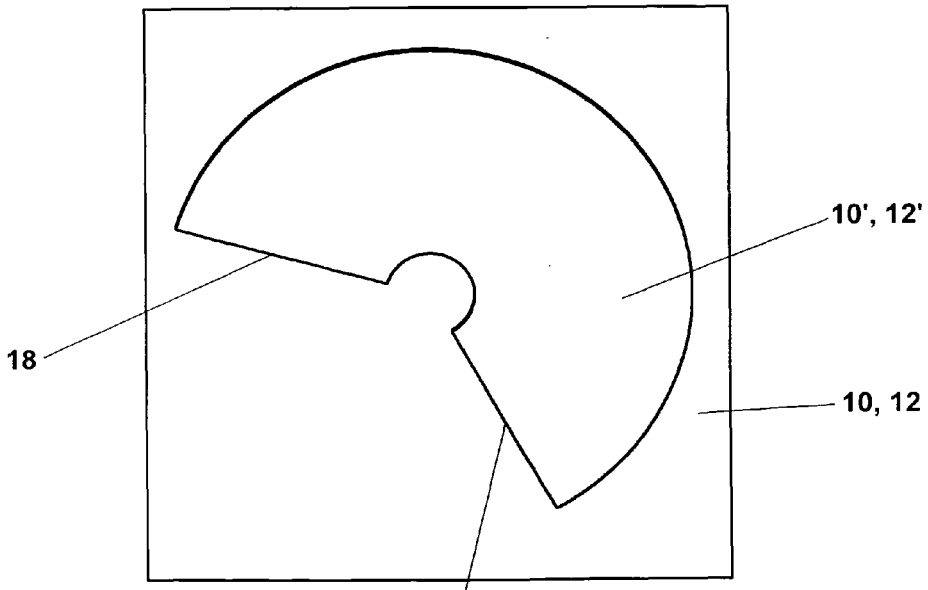
FIG. 2 a plan view on another embodiment of a flat-surfaced and partially circular blank and/or buckling-stable insert and/or truncated-cone shaped embodiment according to the invention of a blank and/or buckling-stable insert according to the invention.

In the further embodiment of the method according to the invention displayed as an example in FIG. 2, the flat-surfaced blank 10 and the at least one buckling-stable insert 12 in contrast are first worked into a flat-surfaced blank 10' and a buckling-stable insert 12', which are each formed as partial circular ring and/or as truncated-cone shaped element. As in the embodiment displayed in FIG. 1, this is worked out by separation, in particular by mechanical cutting, cutting with laser or water jet, sawing, milling or eroding, of the flat-surfaced blank 10 and of the at least one flat-surfaced buckling-stable insert 12.

As schematically displayed in FIG. 3, the flat-surfaced blank 10' formed as partial circular ring and the at least one buckling-stable insert 12', also formed as partial circular ring, are then each joined to a truncated-cone shaped blank 14 to be deformed and/or blank 14 with straight truncated cone and/or blank 14 in form of a straight truncated cone and a truncated-cone shaped buckling-stable insert 16 to be deformed and/or insert 16 with straight truncated cone and/or insert 16 in form of a straight truncated cone. In doing such, the blank 14 to be deformed and the at least one buckling-stable insert 16 to be deformed are welded along opposite surface lines 18, 18'. In the method according to the invention, the friction-stir-welding (FSW) is applied as most preferential welding method.

The blank 14 to be deformed has an inner side 20 and an outer side 22 and also features a small aperture 24 and a large aperture 26. The small aperture 24 is the so-called pole, while the large aperture 26 is an exterior circumference. If so required, the small aperture 24 may be closed with a (pole) cap of any shape to be welded, i.e. in form of a flat disc and a multiple-bent shape (e.g. hemisphere, ball section, pressed/stretched ellipsoid, etc.), in order to dissipate to a greater circumference the force to be exerted upon the blank 14 to be deformed and thus to facilitate shaping. A flange or skirting may be formed on to the large aperture to facilitate clamping for shaping and/or define it geometrically for reproduction.

In contrast, the at least one buckling-stable insert 16, 16', 16" to be deformed usually has no apertures 24, 26, which facilitates shaping even further. However, the at least one insert 16, 16', 16" similar to the blank 14 to be deformed has an inner side 20 and an outer side 22.

In the embodiment displayed in FIG. 1 of the blank 14 to be deformed and of the at least one buckling-stable insert 16 to be deformed, which are essentially provided in circular or discoid shape, their front side corresponds to the inner side 20, while the rear side corresponds to outer side 22 of the blank 14 and insert 16.

According to FIG. 4, the blank 14 to be deformed prior to shaping is preferably supported with at least one buckling-stable insert 16, irrespective of the shape of the blank 14 to be deformed and/or of the at least one buckling-stable insert 16 to be deformed, i.e.

whether this/these is/are circular or discoidal (FIG. 1) or in truncated-cone shape (FIGS. 2 and 3). In the embodiment depicted in FIG. 4, the insert 16 is quasi the base 16' and the insert 16 is quasi the lining 16", respectively of at least one forming tool 32 which be explained in greater detail below.

The inserts 16', 16" are adapted in shape and dimensions to the blank 14 to be deformed. The blank 14 to be deformed and the inserts 16', 16" have essentially the same form. In order to achieve full-surface contact of the inserts 16', 16" at the front or inner side 20 and/or the rear or outer side 22 of the blank 14 to be deformed throughout the entire shaping process, the insert 16 intended as base 16' is actually a bit larger in size than the blank 14 to be deformed. The opposite applies to the insert 16 intended as lining 16". Insofar the insert 16 intended as lining 16" is a bit smaller in size than the blank 14 to be deformed. Owing to the at least one, here two, buckling-stable insert(s) 16', 16", buckling of the blank 14 to be deformed is excluded or at least extremely aggravated. The buckling stability of inserts 16', 16" may be achieved both through their thickness as well as by proper choice of material, i.e. by choosing a material with maximum E-module.

As may also be taken from FIG. 4, the blank 14 to be deformed and the at least one buckling-stable insert 16 to be deformed are then arranged to each other such that the blank 14 and the insert 16 are in full-surface contact with each other after such arrangement and throughout the entire deforming process of the blank 14 to be deformed.

The blank 14 to be deformed and the at least one buckling-stable insert 16 to be deformed are then placed in a bearing structure 28 in a next step of the method according to the invention. The bearing structure 28 may be designed in form of an open rack or as framework structure. In the schematic embodiment, the blank 14 to be deformed and the at least one buckling-stable insert 16 to be deformed come into contact with a clamping device (not depicted) exclusively by a circumference in the area of the large aperture 26. The blank 14 and the at least one insert 16 are, for example, clamped, held and fixed in the clamping device with a pressure ring and a clamping ring as well as possibly a sealing ring between pressure ring and clamping ring (all not depicted) and are thus permanently and reliably clamped during the shaping process.

Apart from clamping the blank 14 to be deformed at the circumference and/or at the circumference in the area of the large aperture 26, the blank 14 to be deformed will not touch the bearing structure 28 between the circumference in the area of the large aperture 26 and the circumference in the area of the small aperture 24. This is done to avoid the formation of any restrictive condition outside the clamping at the large aperture 26.

In the embodiment displayed in FIG. 4, the bearing structure 28 encompasses a chamber 30, which will be described in greater detail below. The chamber 30 is essentially hollow-shaped as cup, pot, bowl, cone, and truncated cone or similar. As may be taken from FIG. 4, the shape of the chamber 30 of the bearing structure 28 deviates from the form and dimension of the blank 14 to be deformed and the at least one buckling-stable insert 16 to be deformed.

In order to avoid the formation of any restrictive condition also during the shaping process, both the blank 14 to be deformed and the at least one buckling-stable insert 16 to be deformed are accommodated without any contact in the bearing structure 28 and/or the chamber 30 also with increasing deformation.

Figure 5:
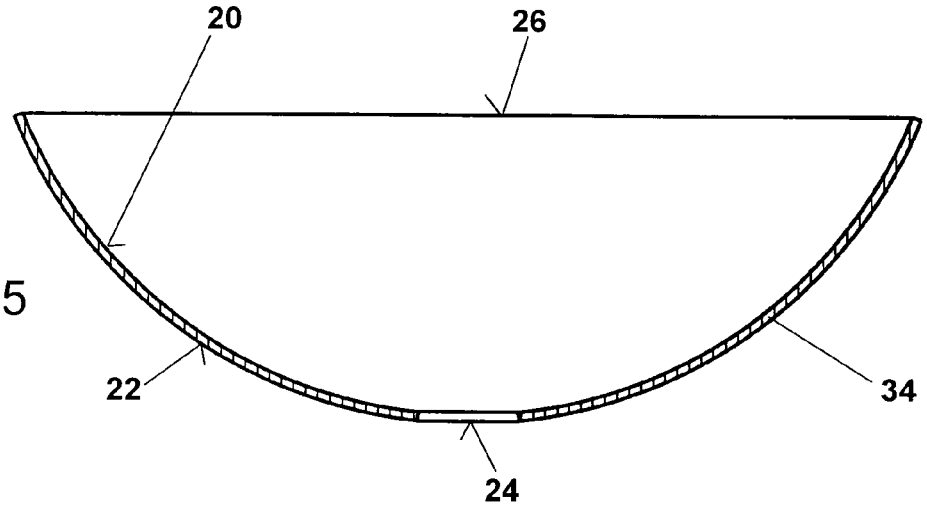
FIG. 5 a schematic cross-sectional view of an embodiment of a shell body according to the invention which was formed from the blank to be deformed as in FIG. 4.

The last step of the method according to the invention follows as also depicted in FIG. 4. In that step, the blank 14 to be deformed and the at least one buckling-stable insert 16, 16', 16" to be deformed are deformed to form the shell body 34 as depicted in FIG. 5 by the at least one forming tool 32. The forming tool 32 impacts upon the front or inner side 20 of the blank 14 to be deformed or the at least one insert 16 to be deformed intended to be lining 16".

One very preferential deforming method according to the invention is by way of concave pressing and/or spin forming of the blank 14 to be deformed and the at least one buckling-stable insert 16, 16', 16' to be deformed. In this context, the blank 14 to be deformed is deformed by at least one forming tool 32 impacting the inner side 20 in form of a forming or pressing roll. In the embodiment in FIG. 4, there are two such forming or pressing rolls in use. As an alternative or also cumulative, at least one preferably hydrostatically mounted pressing ball may also be used.

In alternative embodiment of the method according to the invention by way of concave pressing, it is also possible to shape the blank 14 to be deformed and the at least one buckling-stable insert 16 to be deformed to form the shell body 34 by counter rolling and/or hammering and/or ball peening. In such case, the at least one forming tool 32 is present either as counter roll (not depicted) interacting with the forming tool and contacting the outer side 22 of the blank 14 to be deformed or as at least one hammer and/or as balls made of metal, glass or a combination thereof.

Expediently the forming tool 32, which impacts the front or inner side 20 of the blank 14 to be deformed and the at least one buckling-stable insert 16 to be deformed, is arranged in one level radially to the blank 14 to be deformed and the at least one buckling-stable insert 16, 16', 16" to be deformed two-dimensionally from the center to the circumference of the blank 14 and of the at least one buckling-stable insert 16, 16', 16", and vice versa, in flat-surfaced and essentially circular or discoidal version. In other case, i.e. if shaped as partial circular ring, the forming tool is led from the circumference in the area of a small aperture 24 to the circumference in the area of a large aperture 26 of the blank 14 and of the at least one buckling-stable insert 16, 16', 16", and vice versa. The forming tool 32 is steered and/or controlled by a template or numerical controls.

It is in addition conceivable without being depicted in detail to further refine the method according to the invention such that the blank 14 to be deformed and the at least one buckling-stable insert 16 to be deformed and the at least one forming tool 32 in the process of deforming to form the shell body 34 move relative to each other, particularly in rotation. The arrows 36 in FIG. 4 indicate schematically that the blank 14 to be deformed is stationary in the bearing structure 28, while the forming tool 32 turns and/or rotates. Without being depicted in detail, a kinematic reversal of such might also be advantageous i.e. that the blank 14 to be deformed might be designed to rotate in or together with the bearing structure 28, while the forming tool 32 moves only in radial direction. Finally, a combination of these is also conceivable, so that both the blank 14 to be deformed might be designed to rotate in or together with the bearing structure 28, while the forming tool 32 may also be designed to rotate relative to these.

The blank 14 to be deformed is preferably brought to a higher temperature profile by at least one device (not displayed) allocated to the bearing structure 28 for heating the blank 14 to be deformed. Prior to deformation to form the shell body 34, the blank 14 to be deformed may be soft-annealed. In addition, the blank 14 to be deformed may be subjected to solution heat treatment followed by quenching as well as, where required, by subsequent cold drawing, particularly after almost completed deformation to form the shell body 34. The latter measures are expedient for correcting potential warps, for releasing inner tensions and for homogenous dissipation of structural lattice distortions.

The flat-surfaced blank 10 or the essentially circular or discoidal blank 10' or the blank 10' in partially circular form and/or the blank 14 to be deformed may also prior to deforming to form the shell body 34 be precontoured by machining, particularly by milling, cutting and/or grinding, with a specific rate of wall thickness of the blank 10, 10', 14 being set in order to achieve the desired ultimate wall thickness of the shell body 34. At the same time, it is possible to provide for apertures, perforations or similar excavations, which can be temporarily closed for deforming by the at least one buckling-stable insert 16, 16', 16" to be deformed and/or by separate covers, in particular a foil (none of which is displayed here).

To support the process of deforming the blank 14 to be deformed by the at least one forming tool 32, provisions might be made for defined evacuation. In such process, the outer side 22 of the blank 14 to be deformed facing the bearing structure 28 is sealed against the inner side 20 of the blank 14 to be deformed opposite to the bearing structure 28, and a vacuum is applied at a chamber 30 of the bearing structure 28 closed against the blank 14 to be deformed. For this purpose, the bearing structure 28 may, for example, be designed as framework rack with vacuum-tight wall or the chamber 30 may be designed as vacuum chamber. Apertures, perforations or similar excavations at the flat-surfaced blank 10 and/or the planar blank 12 as straight circular cone and/or the blank 14 to be deformed may be temporarily sealed during the deforming process by separate covers, in particular a foil, or in advantageous application by the buckling-stable insert(s) 16', 16".

During the process of deforming to form the shell body 34, the blank 14 to be deformed preferably is consistently measured.

Finally, the shell body 34 after deforming is heat-soaked in the bearing structure 28 or in the oven, and is brought to status T8.

The method according to the invention is not restricted to the described embodiments. It is, for example, possible to use only one insert 16 instead of two buckling-stable inserts 16, i.e. base 16' and lining 16", and to allocate such to the blank 14 to be deformed; this one insert 16 shall then be used either as base 16' or as lining 16".

The invention claimed is:

1. A method for shaping an essentially flat-surfaced blank (10) to form a shell body (34), comprising the following steps:

providing a first flat-surfaced blank (10) having a shape, dimension and deformation properties;

providing at least one first flat-surfaced buckling-stable insert (12) having a shape, dimension and deformation properties wherein the shape, dimension and deformation properties are adapted to the shape, dimension and deformation properties of the first flat-surfaced blank (10);

forming a second blank (14) and at least one second buckling-stable insert (16, 16', 16") from the first flat-surfaced blank (10, 10') and from the at least one first flat-surfaced buckling-stable insert (12, 12'), wherein the forming comprises working the first flat-surfaced blank (10) and the at least one first flat-surfaced buckling-stable insert (12) and whereby the worked first flat-surfaced blank (10) forms the second blank (14) and the worked at least one first flat-surfaced buckling-stable insert (12) forms the at least one second buckling-stable insert (16, 16', 16"), and wherein the at least one second buckling-stable insert (16, 16', 16") includes one of a base (16') and a lining (16"), the base (16') being in its dimensions larger than the second blank (14) and the lining (16") being in its dimensions smaller than the second blank (14), the second blank (14) and the at least one second buckling-stable insert (16, 16', 16") having essentially the same form;

positioning the second blank (14) and the at least one second buckling-stable insert (16, 16', 16") to each other such that the second blank (14) and the at least one second buckling-stable insert (16, 16', 16") are in full-surface mutual contact;

clamping the second blank (14) and the at least one second buckling-stable insert (16) in or at a bearing structure (28); and deforming the second blank (14) together with the at least one second buckling-stable insert (16, 16', 16") with the help of at least one forming tool (32) contacting a front or inner side (20) of the second blank (14) or of the at least one second buckling-stable insert (16) that is the lining (16") to form the shell body (34), wherein the second blank (14) and the at least one second buckling-stable insert (16, 16', 16") are each formed such that the second blank (14) and the at least one second buckling-stable insert (16, 16', 16") are each shaped as a partially circular ring including opposite surface lines (18, 18'), and further comprising joining each of the second blank (14) and the at least one second buckling-stable insert (16, 16', 16") along the opposite surface lines (18, 18'), thereby making the form of a truncated cone.

2. The method according to claim 1, wherein forming the second blank (14) and the at least one second buckling-stable insert (16, 16', 16") by working the first flat-surfaced blank (10) and the at least one first flat-surfaced buckling-stable insert (12) comprises working by separating, including one of mechanical cutting, cutting with laser or water jet, sawing, milling or eroding.

3. The method according to claim 1, wherein the joining along the opposite surface lines (18, 18') is by friction-stir-welding (FSW).

4. The method according to claim 1, wherein deforming the second blank (14) together with the at least one second buckling-stable insert comprises concave pressing and/or spin forming and/or counter-rolling and/or hammering and/or ball peening.

5. The method according to claim 1, wherein the at least one forming tool (32) is in the form of one of a forming or pressing roll and/or a pressing ball, which is hydrostatically mounted, at least one interacting counter roll which contacts a rear or outer side (22) of the second blank (14) and of the at least one second buckling-stable insert (16, 16', 16") and/or by at least one hammer and/or balls made of metal, glass or a combination thereof.

6. The method according to claim 5, wherein the forming tool (32) is steered and/or controlled by a template or numerical controls during the step of deforming the second blank (14) together with the at least one second buckling-stable insert (16, 16', 16").

7. The method according to claim 1, wherein the second blank (14) and the at least one second buckling-stable insert (16, 16', 16") and the at least one forming tool (32) move relative to each other during the step of deforming the second blank (14) together with the at least one second buckling-stable insert (16, 16', 16").

8. The method according to claim 1, further comprising heating the second blank (14) to a higher temperature profile by at least one device allocated to the bearing structure (28) for heating the second blank (14).

9. The method according to claim 1, further comprising soft-annealing the second blank (14) prior to the step of deforming the second blank (14) together with the at least one second buckling-stable insert (16, 16', 16").

10. The method according to claim 1, further comprising precontourinq one of the first flat-surfaced blank (10) and the second blank (14) by machining, including one of milling, cutting and/or grinding, prior to the step of deforming the second blank (14) together with the at least one second buckling-stable insert (16, 16', 16"), whereby a specific and particular wall thickness of the first flat-surfaced or second blank (10, 10', 14) for achieving a particular ultimate wall thickness of the shell body (34) is provided, and/or is fitted with apertures, perforations or similar excavations, which are temporarily closed for deforming by the at least one second buckling-stable insert (16, 16', 16") and/or covers.

11. The method according to claim 1, further comprising:

sealing a rear or outer side (22) of the second blank (14) and of the at least one second buckling-stable insert (16) intended as base (16') facing the bearing structure (28) against the front or inner side (20) of the second blank (14) and of the at least one second buckling-stable insert (16) intended as lining (16") opposite to the bearing structure (28); and applying a vacuum at a chamber (30) of the bearing structure (28) closed against the second blank (14) and/or against the at least one second buckling-stable insert (16, 16', 16") in order to support the step of deforming the second blank (14).

12. The method according to claim 1, further comprising consistently measuring the second blank (14) while deforming the second blank (14).

13. The method according to claim 1, further comprising:

prior to deforming the second blank (14):

subjecting the second blank (14) to solution heat treatment; and thereafter subjecting the second blank (14) to quenching and/or subsequent cold drawing.

14. The method according to claim 1, further comprising heat-soaking the shell body (34) in the bearing structure or in the oven, wherein the shell body (34) is brought to status T8.

15. The method according to claim 1, wherein the first flat-surfaced blank (10, 10') and/or the at least one first flat-surfaced buckling-stable insert (12, 12') and/or the second blank (14) and/or the at least one second buckling-stable insert (16, 16', 16") is/are made of metal and/or plastic and/or ceramics and/or a combination thereof.

16. The method according to claim 15, wherein the at least one first flat-surfaced buckling-stable insert (12, 12') or the at least one second buckling-stable insert (16, 16', 16") is made of a material with a high E-modulus.

17. The method according to claim 15, wherein the first flat-surfaced blank (10, 10') and the at least one first flat-surfaced buckling-stable insert (12, 12'), and/or the second blank (14) and the at least one second buckling-stable insert (16, 16', 16"), are made of one of steel, stainless steel, aluminum, titanium, an alloy thereof and/or a combination thereof.

18. The method according to claim 15, wherein the first flat-surfaced blank (10, 10') and the at least one first flat-surfaced buckling-stable insert (12, 12'), and/or the second blank (14) and the at least one second buckling-stable insert (16, 16', 16"), are made of one of high and super high strength aluminum alloys and aluminum alloys containing lithium.

19. The method according to claim 15, wherein the first flat-surfaced blank (10, 10') and the at least one first flat-surfaced buckling-stable insert (12, 12'), and/or the second blank (14) and the at least one second buckling-stable insert (16, 16', 16"), are made of one of a curable aluminum alloy AL 2195 or AL 2219.

* * * * *